US009975351B1

(12) United States Patent
Luedeman et al.

(10) Patent No.: US 9,975,351 B1
(45) Date of Patent: May 22, 2018

(54) PRINT DRYER HEATER CONTROL

(71) Applicant: Hewlett-Packard Development Company, L.P., Houston, TX (US)

(72) Inventors: Timothy Jacob Luedeman, Washougal, WA (US); Robert Matthew Yraceburu, Camas, WA (US); Daniel James Magnusson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/418,951

(22) Filed: Jan. 30, 2017

(51) Int. Cl.
*B41J 2/165* (2006.01)
*B41J 11/00* (2006.01)

(52) U.S. Cl.
CPC ..... *B41J 11/0015* (2013.01)

(58) Field of Classification Search
None
See application file for complete search history.

(56) References Cited

U.S. PATENT DOCUMENTS 5,481,089 A * 1/1996 Furuta ..... G03G 15/2003 219/216
5,801,360 A 9/1998 Oba et al.
5,811,764 A 9/1998 Hirst
5,899,599 A 5/1999 Kato
6,293,668 B1 * 9/2001 Kubby ..... B41J 11/0015 347/101
6,333,493 B1 * 12/2001 Sakurai ..... F26B 3/28 118/725
7,976,115 B2 7/2011 Gibson et al.
8,023,851 B2 9/2011 Cao et al.
2007/0188536 A1 * 8/2007 Tanaka ..... B41J 11/002 347/17

FOREIGN PATENT DOCUMENTS

JP 201318025 A 10/2013

OTHER PUBLICATIONS

Anbarasan, M et al., Modified PID Controller for Avoiding Overshoot in Temperature of Barrel Heating System, Jan. 7-9, 2013, < http://ieeexploreleee.org/document/6496531/ >.

* cited by examiner

*Primary Examiner* — Alejandro Valencia
(74) *Attorney, Agent, or Firm* — Robert Sismilich

(57) ABSTRACT

In one example, a method for controlling temperature of a print dryer. High power is applied to a heater of the print dryer. A series of temperatures of the print dryer are periodically measured and stored until a target temperature for the print dryer is exceeded. Low power is applied to the heater after the target temperature is exceeded. A rate of temperature change at a time when the target temperature was exceeded is calculated from the stored temperatures. Using the rate, an initial heater duty cycle defining an initial heater power determined. PID control of the heater power is performed, beginning with the initial heater duty cycle, to maintain the print dryer temperature at the target temperature within a predefined accuracy.

13 Claims, 8 Drawing Sheets

PRINT DRYER HEATER CONTROL

BACKGROUND

Many printers, such as inkjet printers for example, include a dryer to produce heat so as to evaporate liquids from an ink that is applied to a printed page. Such a dryer may help reduce media curl and ink smear, and provide better quality printed output in general. In some examples, a dryer may use heating elements and other components that may collectively consume a considerable amount of power during operation. Many countries or regions around the world have adopted regulatory requirements that are related directly or indirectly to power consumption in electronic equipment, and which printers are responsible for meeting.

DETAILED DESCRIPTION

Figure 1:
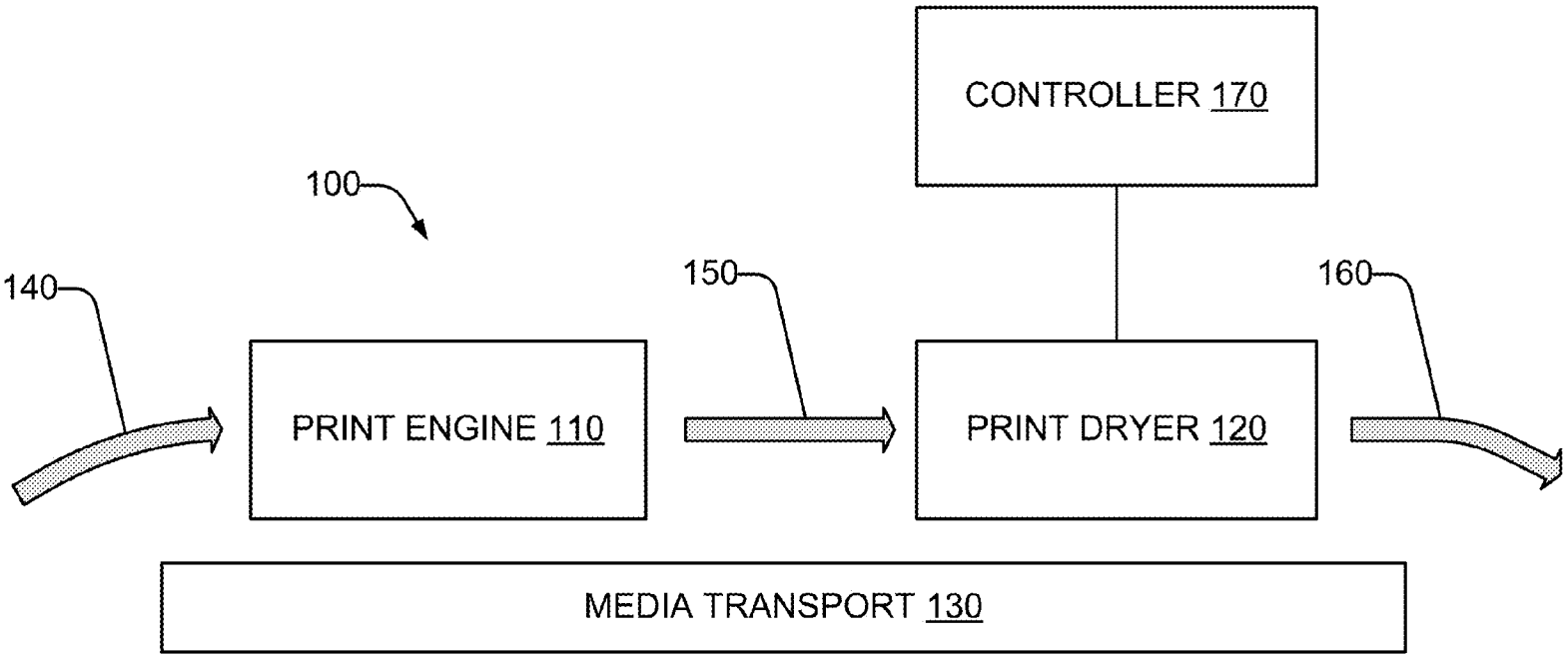
FIG. 1 is a schematic representation of a printer in accordance with an example of the present disclosure.

One regulatory requirement that many electronic products are responsible for meeting is a flicker requirement. Flicker refers to a change in the brightness of electric lights, visually perceptible to a human observer, that is caused by rapid voltage fluctuations in a power source which powers the equipment caused by changes in load current drawn from the power source by the equipment. Flicker may cause persons with epilepsy to suffer an attack. It may also adversely affect the operation of sensitive electrical equipment connected to the power source. Regulatory standards for flicker include IEC 61000-3, IEC 61000-4, and similar standards.

In order to prevent flicker or reduce it to an acceptable limit, the electrical equipment may reduce the load current it draws, and/or change the frequency at which the load current changes are made. Changing the frequency often means making changes in load current occur less frequently.

A print dryer for a printer may include a heater having heating elements, such as for example wire heating elements, which convert electrical energy to heat. The print dryer, in large measure due to the heating elements, may draw a significant amount of power from the power source, such as for example 500 watts, 1000 watts, or more. The heater may be controlled via a duty cycle, which for a given period of time specifies the percentage of time within that period during which the heating elements are turned on (the heating elements are turned off for the remainder of that period). For a 100% duty cycle, the heating elements are on throughout the entire period, while for a 0% duty cycle, the heating elements are off throughout the entire period. Varying the duty cycle effectively makes it a variable-power heater.

To maintain the temperature of the print dryer close to a target temperature—in other words, within a predefined accuracy for the target temperature—the duty cycle may be increased when the temperature drops below the target temperature, and decreased when the temperature rises above the target temperature. In general, for a given print dryer, the tighter the predefined accuracy, the more frequently the duty cycle should be changed. However, high power consumption (which draws significant current at line voltages) coupled with frequent changes in duty cycle can cause excessive flicker. To avoid such flicker, the maximum frequency at which heater duty cycle changes may be made is limited. Limiting the frequency of heater duty cycle changes can adversely affect the temperature accuracy which can be achieved. It may also adversely impact the amount of time it takes to bring the print dryer temperature to the target temperature within the predefined accuracy when print dryer heating is initiated.

In some examples the target temperature is an absolute temperature, while in other examples the target temperature is a relative number of degrees above an ambient temperature.

Referring now to the drawings, there is illustrated an example of a printer having a print dryer. The print dryer is heated to a target temperature. From the rate of temperature change at the target temperature, an initial duty cycle for the heater is determined. The initial duty cycle is applied to a PID controller (proportional-integral-derivative control loop feedback mechanism) to maintain the print dryer temperature at the target temperature within a predefined accuracy.

Considering now one example of a printer, and with reference to FIG. 1, a printer 100 includes print engine 110, a print dryer 120, and a media transport mechanism 130. The media transport mechanism 130 moves media through the printer 100. The media transport mechanism 130 feeds a source medium 140 to the print engine 110. The medium 140 may be any type of suitable sheet or roll material, such as paper, card stock, cloth or other fabric, transparencies, mylar, and the like, but for convenience the illustrated examples are described using paper as the medium.

The print engine 110 marks the source medium 140 with desired print content, which may be textual and/or graphical (including images) in nature, to produce a wet medium 150. The print engine 110 may use any marking technology that produces a wet medium 150 containing liquid or moisture to be subsequently removed. In one example, the print engine 110 operates using inkjet technology, which may utilize pigments, dyes, and/or other substances in a liquid carrier to produce the markings on the source medium 140.

The media transport mechanism 130 feeds the wet medium 150 to the print dryer 120. The dryer 120 removes the liquid and/or moisture from the wet medium 150 through the application of heat to produce a dried medium 160 which is output and removed from the dryer 120 by the media transport mechanism 130.

The printer 100 also includes a controller 170 which is coupled to the print dryer 120. The controller 170 may also be coupled, in some examples, to the print engine 110 and/or the media transport mechanism 130. The controller 170 controls heating of the print dryer 120, including heating the print dryer 120 to a target temperature during a temperature ramp-up phase, and then maintaining the print dryer 120 at the target temperature within a predefined accuracy during a temperature control phase.

The target temperature allows for optimal drying of the wet medium 150. In addition, by preventing the dryer temperature from exceeding the upper limit, damage to the dried medium 160 (such as curling, for example), and damage to the dryer 120 (such as tripping thermal protection fuses, and/or damaging plastic or rubber parts, for example) is avoided.

In some examples, the wet medium 150 is provided to the print dryer 120 after the target temperature has been achieved. In other examples, the wet medium 150 is provided to the print dryer 120 during the ramp-up phase before the target temperature has been achieved.

Figure 2:
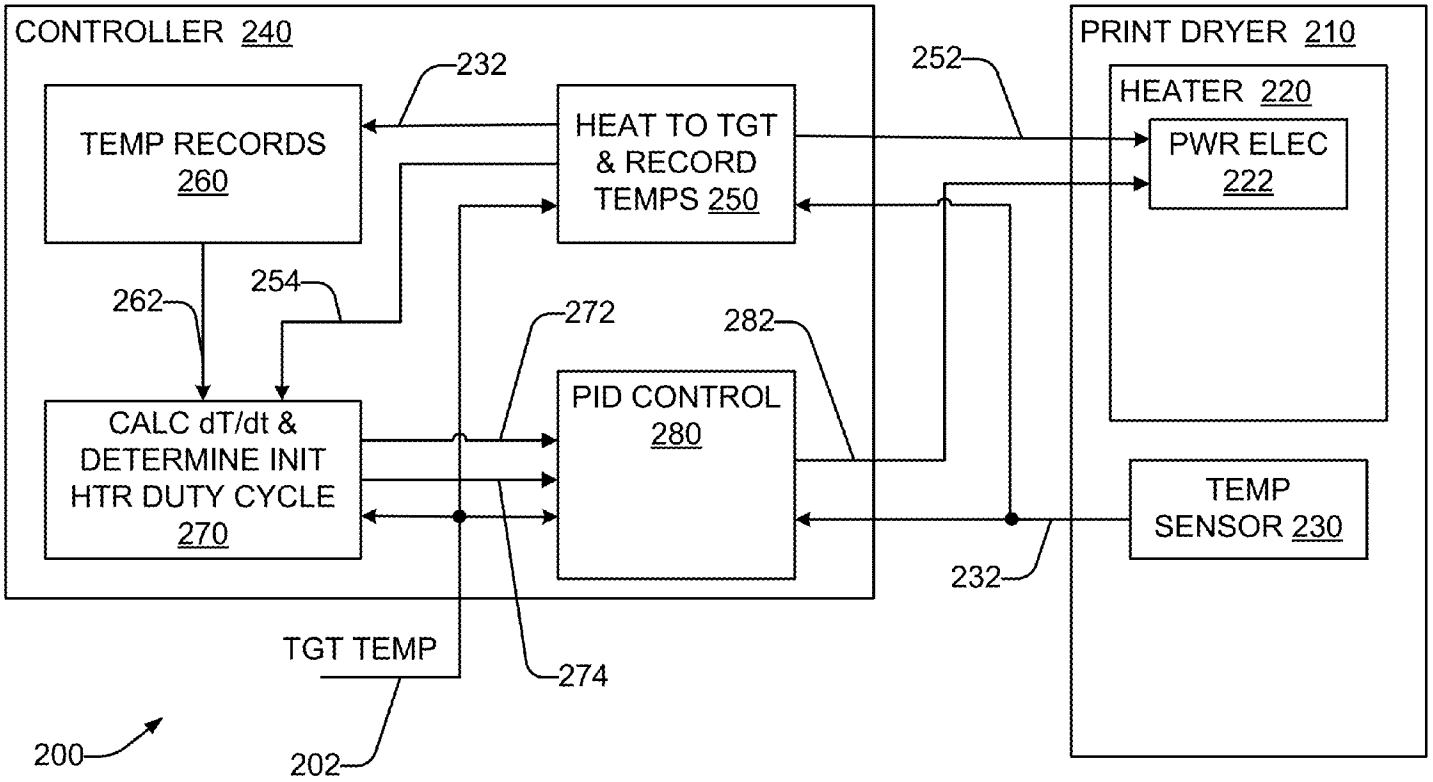
FIG. 2 is another schematic representation of a printer in accordance with an example of the present disclosure.

Considering now another example of a printer, and with reference to FIG. 2, a printer 200 includes a print dryer 210 and a controller 240. The print dryer 210 includes a variable-power heater 220 having a power level controllable by a duty cycle, and a temperature sensor 230 to periodically measure and record an internal temperature of the print dryer 210. In one example, the duty cycle is applied to a pulse width modulator circuit which is coupled to heating elements of the heater 220. However, in other examples the duty cycle may be utilized by a different control circuit.

In some examples, the print dryer 210 may also include a fan (not shown) to circulate air and moisture in the dryer 210, to expel heated air from the dryer 210, and to draw unheated air into the dryer 210.

The controller 240 is coupled to the print dryer 210. The heater 220 of the print dryer 210 receives a duty cycle command 252 from the controller 240, and power electronics 222 in the heater 220 energize heating elements (such as for example wire heating elements, not shown) in the heater 220 at the specified duty cycle. In one example, the duty cycle is used by a pulse width modulator in the power electronics 222 which drives the heating elements.

The temperature sensor 230 of the print dryer 210 (which in some examples is a thermistor) also provides a temperature measurement 232 to the controller 240. In some examples the temperature measurement is provided periodically, while in other examples the temperature measurement is provided in response to a command from the controller 240.

A ramp-up function 250 of the controller 240 sends a high duty cycle command 252 to the heater 220 to heat the dryer 210 to a specified target temperature 202 during a temperature ramp-up phase. The target temperature may be +30 degrees C. relative to ambient, or a greater or lesser value. In one example, the ramp-up function is invoked in response to receipt of a print job by the printer 200. The ramp-up function 250 also acquires dryer temperature measurements 232 from the temperature sensor and records 232 these as temperature records 260. In some examples each temperature measurement 232 includes an associated time-stamp, while in other examples each temperature measurement 232 has a known time relationship to the previous recorded temperature measurement. When the ramp-up function 250 detects from the temperature measurements 232 that the dryer temperature has exceeded the target temperature 202 by a predefined amount, the ramp-up function 250 stops recording temperatures and applies a low duty cycle command 252 to the heater 220. In one example, the high duty cycle is 100% (full power), the low duty cycle is 0% (heater is off), and the predefined amount is 1 degree C.

At this point, the ramp-up function 250 concludes, and an initial heater duty cycle determination function 270 is invoked. In one example, the ramp-up function 250 may send a signal 254 to the initial heater duty cycle determination function 270 to invoke it. The initial heater duty cycle determination function 270 accesses recorded temperatures 262 from the temperature records 260, and calculates from the recorded temperatures 262 the rate of temperature change (dT/dt) that was occurring in the dryer 210 at an end portion of the time period when the high duty cycle is applied to the heater 220, before the low duty cycle is applied to the heater 220. In some examples, the end portion encompasses the time when the measured temperature 232 crossed the target temperature 202 (i.e. from just below the target temperature 202, to just above it). In one example, the rate of temperature change is determined as a slope of a line fit through the temperature measurements over the range of a predefined number of seconds. In one example, this range is the last 2 seconds of temperature measurements 262 recorded by the ramp-up function 250.

The initial heater duty cycle determination function 270 then uses the calculated rate of temperature change to determine an initial heater duty cycle corresponding to the rate (or the slope). The initial heater duty cycle is communicated 272 to a PID controller (or PID control loop) 280 of the controller 240. The PID controller 280 uses the initial heater duty cycle 272 as the initial value of the heater duty cycle 282 it applies to the heater 220. In some examples, the initial heater duty cycle determination function 270 also commands 274 the PID controller 280 to immediately apply the initial heater duty cycle 272 to the heater 220. In some examples, the time between the ramp-up function 250 setting the duty cycle to 0%, and the time the PID controller 280 applies the initial heater duty cycle 272 to the heater 220 can be quite short; a fraction of a second.

After the initial heater duty cycle 272 has been applied to the heater 220, the PID controller 280 performs PID control of the heater 220 to maintain the temperature of the print dryer 210 at the target temperature 202 (i.e. the setpoint) within a predefined accuracy. The PID controller 280 receives temperature measurements (i.e. the process variable) from the temperature sensor 230. During PID control, and after applying the initial heater duty cycle 272 to the heater 210, the heater duty cycle 282 (i.e. the control variable) applied to the heating elements of the heater 210 changes no more frequently than every one second, so as to keep the amount of flicker within acceptable limits.

In one example, the heater 210 consumes a sufficiently large amount of power such that, to keep flicker within acceptable limits, the duty cycle applied to the heating elements of the heater 210 is changed no more frequently than every six seconds. In one such example, the predefined accuracy for the target temperature is less than or equal to +/−5 degrees C. or +/−16% of the target temperature. In another such example, the predefined accuracy for the target temperature is less than or equal to +/−1 degrees C. or +/−3% of the target temperature.

In some examples, while the heater duty cycle 282 applied to the heating elements of the heater 210 changes no more frequently than every one second (and in some examples less frequently), the PID controller 280 may receive temperature measurements and calculate potential values for the heater duty cycle 282 more frequently. For example, the PID controller 280 may have a cycle time of 200 milliseconds, and thus calculate new potential values for the heater duty cycle 282 five times per second. However, the most recently calculated value of the heater duty cycle 282 is applied to the heating elements at the time the heater duty cycle value is changed. In some examples, the limitation on how frequently the heater duty cycle 282 can be applied to the heating elements of the heater 210 is enforced by the power electronics 222 of the heater 220. In such cases, the PID controller 280 may send heater duty cycle 282 values to the power electronics 222 more frequently, based on the cycle time of the controller 280. In other examples, the PID controller 280 enforces the limitation on how frequently the heater duty cycle 282 can be applied to the heating elements of the heater 210, and sends heater duty cycle 282 values to the power electronics 222 no more frequently than allowable.

The printer 200 may also include a print engine and a media transport mechanism, which may be the same as or similar to the print engine 110 and the media transport mechanism 130 of the printer 100 of FIG. 1. The controller 240 may also be coupled to the print engine and/or media transport mechanism to control their operation and/or coordinate their operation with the operation of the print dryer 210.

Figure 3A:
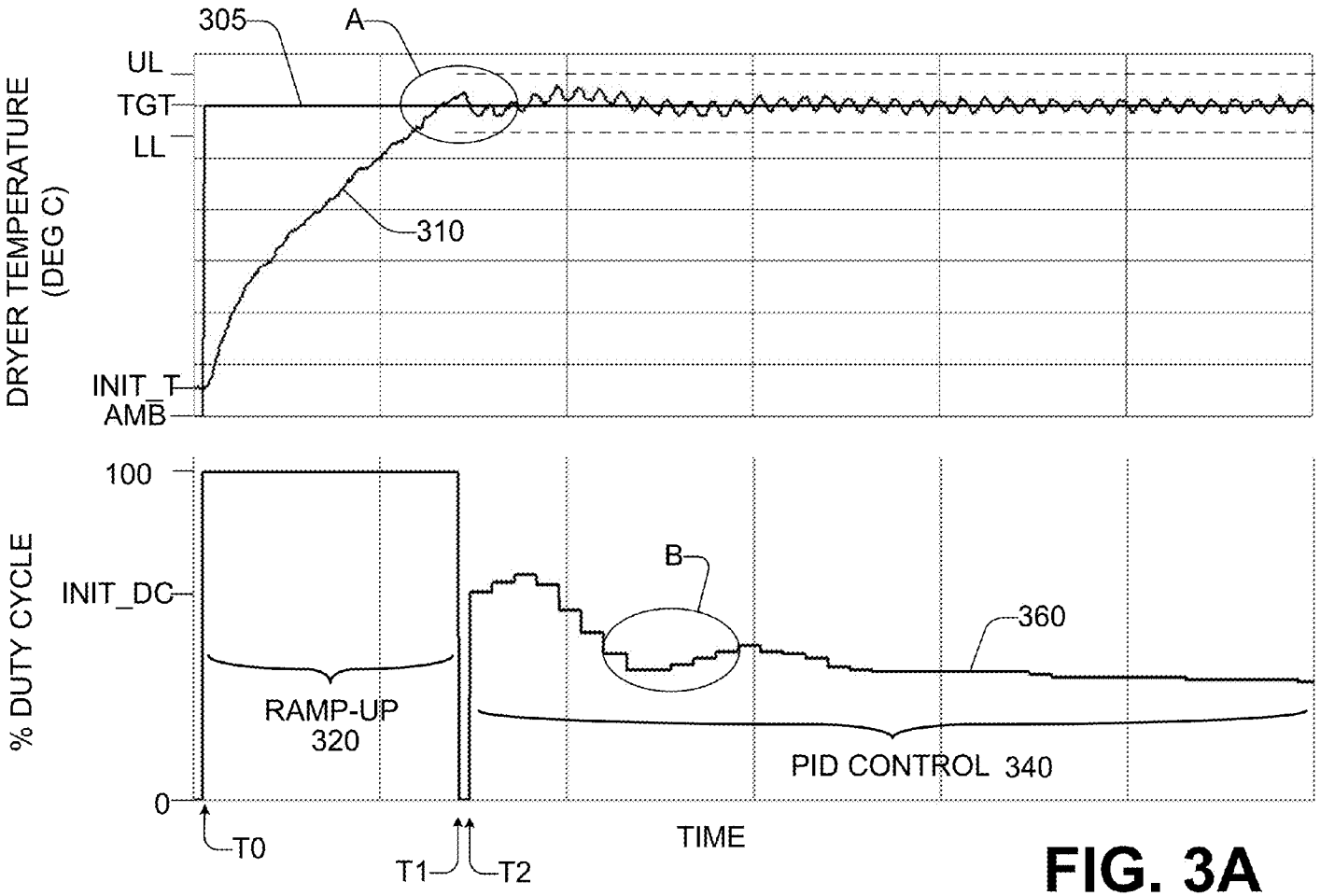
FIGS. 3A-3C are examples of a heating operation of a print dryer usable with the printer of FIGS. 1 and 2, in accordance with an example of the present disclosure.
Figure 3B:
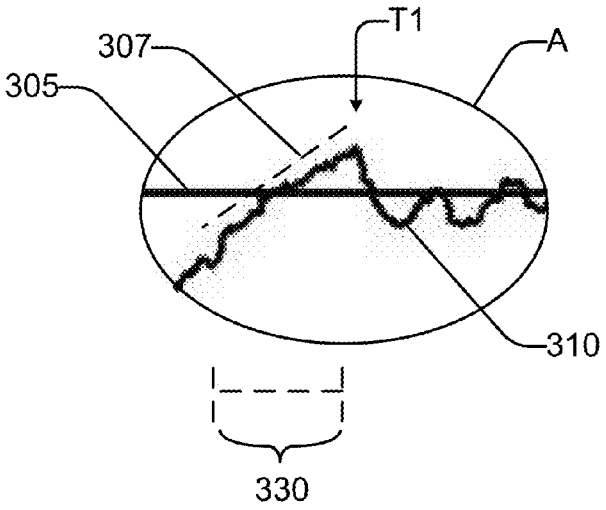
Figure 3C:
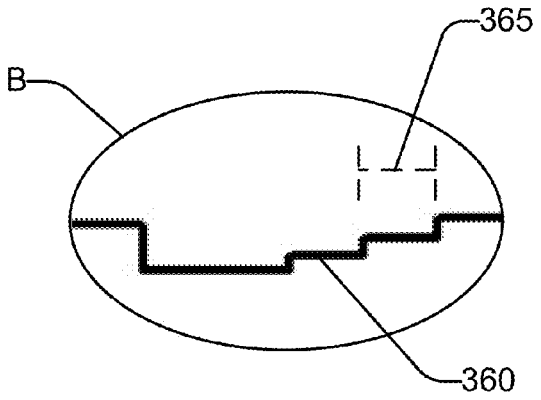

Considering now an example operation of a print dryer, and with reference to FIGS. 3A-3C, heating of the print dryer from an initial temperature to a target temperature and maintaining the printer dryer at the target temperature during print drying is depicted, along with the corresponding heater duty cycle applied to a heater of the print dryer to achieve and maintain the target temperature. In various examples, the print dryer may be the print dryer 120 (FIG. 1) of the printer 100, or the print dryer 210 (FIG. 2) of the printer 200.

FIG. 3A has a top graph illustrating dryer temperature 310 versus time, and a bottom graph of the heater duty cycle 360 versus time. The time scale is the same for both graphs. Heating of the dryer commences with the application of a high level of power (in this example, full power with a duty cycle of 100%) to the heater when the dryer is at an initial temperature ("INIT_T"). In this example, full power is applied at time T0, which in some examples is the time when the printer receives a print job to be printed. The initial temperature may be ambient temperature ("AMB"), or some temperature above ambient. If the printer has been idle for a sufficiently long period of time, the initial temperature will be at or near the ambient temperature. If the printer has performed a print job relatively recently, the initial temperature may be somewhere between the ambient temperature and the target temperature 305 ("TGT").

Application of the high level of power begins the ramp-up phase 320 of operation. The dryer temperature 310 ramps up towards the target temperature 305. At time T1, when the dryer temperature 310 crosses from below the target temperature 305 to above the target temperature 305 and exceeds the target temperature 305 by a predefined amount, the duty cycle is set to a low level of power (in this example, a duty cycle of 0% which turns the heater off). This ends the ramp-up phase 320, and the temperature 310 begins to fall back towards the target temperature 305.

FIG. 3B illustrates portion A of the graph of temperature 310 in enlarged form. After time T1, in one example, a controller which has been recording a temperature history of the print dryer during the ramp-up phase 320 calculates a rate of temperature change that was occurring at or near the time when the dryer temperature 310 achieved the target temperature 305 as it was crossing from below the target temperature 305 to above it. In another example, the controller calculates a rate of temperature change that was occurring at the end of the ramp-up phase 320, before the low level duty cycle is set. In some examples, calculating the rate of temperature change using temperature measurements collected at or near this time ensures that the rate of temperature change is calculated at the same point in the ramp-up phase 320 regardless of the initial temperature of the dryer at the beginning of the ramp-up phase 320, and ensures that there will be sufficient time to collect a sufficient number of measurements to perform an accurate calculation of the temperature change rate even if the initial temperature of the print dryer at the start of the ramp-up phase 320 is close to the target temperature 305. In some examples, the rate is determined by fitting a line to the temperature history during a slope calculation period 330 and determining a slope 307 of this line. In some examples, the rate is calculated over the last N seconds of the temperature history of the ramp-up phase 320. In one such example, N is two seconds.

The controller uses the rate of temperature change to determine an initial value for the heater duty cycle ("INIT_DC") to be applied to the heater by a PID control loop which maintains the dryer temperature at the target temperature within a predefined accuracy. The PID control phase 340 begins at time T2 with the application to the heater of the initial heater duty cycle (which replaces the previous low level of power duty cycle applied between T1 and T2). In one example, the time from T1 to T2 is quite short, a fraction of a second used to calculate the rate of temperature change and determine the initial heater duty cycle.

The initial heater duty cycle is the heater duty cycle to maintain the dryer at the target temperature 305. An initial integral error term that gets preloaded to the PID control loop is calculated based on the initial heater duty cycle and the rate of temperature change, according to the formula:

$$IIET=(IHDC-(Kp*Et)-(Kd*Ed))/Ki$$

where

IIET=initial integral error term

IHDC=initial heater duty cycle

Kp=proportional term gain constant (based on system characteristics)

Kd=derivative term gain constant (based on system characteristics)

Ki=integral term gain constant (based on system characteristics)

Et=temperature error (=target temperature−dryer temperature)

Ed=temperature derivative error (=rate of temperature change)

If execution of the PID control loop were to be begun without providing the initial integral error term, a significant amount of undesirable dryer temperature sag or overshoot is likely to occur as the PID control loop constructs its own error term from scratch. If the heater duty cycle applied by the PID control loop is too low, the dryer temperature would sag and the PID control loop would calculate larger error terms and, thus, a larger resultant heater duty cycle. But until the PID control can react, the dryer temperature would sag. Conversely, if the duty cycle applied is too high for the amount of heat already stored in the dryer materials, the dryer temperature will overshoot the target temperature until the PID controller can adjust, which takes time since the nature of PID control relies on the error terms that are periodically calculated.

FIG. 3C illustrates portion B of the graph of the heater duty cycle 360 in enlarged form. A minimum time delay 365 between changes in the value of the heater duty cycle is enforced during PID control. The time delay between changes in duty cycle, which may be enforced by the PID control loop or the power electronics of the heater, exacerbates the sag and/or overshoot, because the PID control loop is constrained from responding more rapidly to changes in the dryer temperature. In one example, where the target temperature 305 is +30 degrees C. above ambient and the time delay is 6.1 seconds, the temperature sag/overshoot could be as much as +/−25% if the integral error term is not pre-loaded. However, by supplying the initial heater duty cycle and the integral error term to the PID control loop, the temperature sag/overshoot is reduced to +/−7% or less. The upper limit ("UL") in the temperature graph of FIG. 3A represents the target temperature plus 7%, while the lower limit ("LL") represents the target temperature minus 7%.

Figure 4:
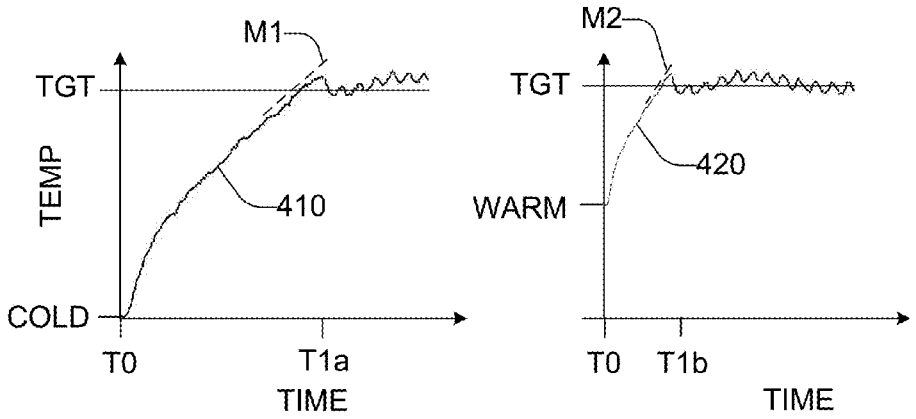
FIG. 4 is a graph of heating operation of a print dryer from two different initial temperatures, in accordance with an example of the present disclosure.

Considering now a print dryer in greater detail, and with reference to FIG. 4, the print dryer has a thermal mass (the ability of matter to absorb and store heat energy) which affects the rate of temperature change in the dryer produced by the heater. In some examples, the dryer is not a closed system, but instead includes a vent and a fan which expels some air from the interior of the print dryer and pulls in some fresh, ambient air. The higher the fan speed, the more air that is expelled, and the more ambient air that comes into the dryer. The air that is expelled is heated air, more heat energy is lost from the dryer at higher fan speeds than at lower fan speeds. This also affects the rate of temperature change, causing the temperature to rise slower at a higher fan speed.

Another factor which affects the rate of temperature change is the initial temperature of the print dryer at T0, the time when the ramp-up phase begins. The rate of temperature change is negatively proportional to a difference between the target temperature and a lower temperature of the dryer at the time full power is applied to the heater. In other words, the greater the difference between the target temperature and a lower temperature of the dryer at the time full power is applied to the heater, the slower the rate of temperature change. For temperature curve 410, the print dryer begins at a low temperature ("COLD"), and is heated to the target temperature ("TGT"). For temperature curve 420, the print dryer begins at a higher temperature ("WARM"), and is heated to the target temperature ("TGT"). The difference between the target temperature and the low temperature is greater than the difference between the target temperature and the higher ("WARM") temperature. Because the initial temperature of the dryer is closer to the target temperature in curve 420 than in curve 410, curve 420 crosses the target temperature in a faster time T1*b* than does curve 410 at time T1*a*. This is partially caused by a difference in the rate of temperature change for the two curves 410, 420. Curve 410, which had a lower initial temperature, has a slope M1 which is smaller (i.e. shallower, or less steep) than slope M2 for curve 420, which had a higher initial temperature. Therefore, the rate of temperature change is slower for curve 410 than for curve 420. A slower rate of temperature change (shallower slope) corresponds to a print dryer that has relatively less stored heat, and a faster rate of temperature change (steeper slope) corresponds to a dryer that has relatively more stored heat at the start of the ramp-up phase T0.

When the dryer is first started after the printer has been idle for a time, all of its components will be at ambient temperature. As heat is applied by the heater, the materials inside and around the dryer soak up or absorb a portion of the heat energy from the air. This slows down the rate at which the air temperature rises (i.e. the rate of temperature change), which is the characteristic used to determine the initial heater duty cycle for PID control. The heater heats up and starts heating the air around it, but the air gives up energy into the surrounding mechanical parts. This accounts, at least in part, for why the slope is shallower when heating from near ambient in temperature curve 410, as compared to heating from nearer the target temperature in curve 420.

Every time a print job is completed, some amount of heat energy is stored in the dryer. As more print jobs are performed, the dryer accumulates more energy (heat) that is stored in the system, which means that less energy (i.e. a lower heater duty cycle) will be employed to achieve the same target temperature. As the delta temperature between the heated air and surrounding materials is lessened over time, the heat transfer into the surrounding materials slows down, and the rate of temperature change (dT/dt slope) increases. This is due, at least in part, because the heat energy transfer rate is proportional to the temperature difference between two objects—in this case, the print dryer and/or its air, and the surrounding components and materials.

Figure 5:
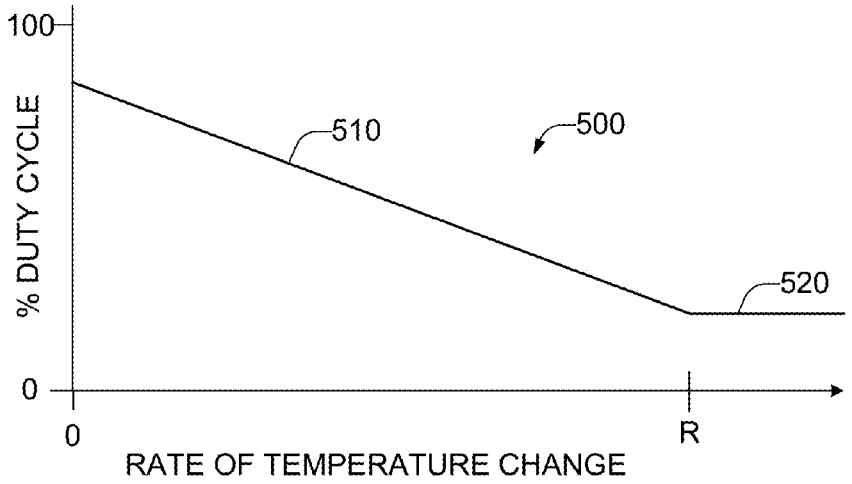
FIG. 5 is a graph of an example relationship between a rate of temperature change of a print dryer and an initial heater duty cycle value for PID control of the print dryer, in accordance with an example of the present disclosure.

Considering now the determination of the initial heater duty cycle using the rate of temperature change (dT/dt slope), and with reference to FIG. 5, in one example a piecewise-continuous function associated with a target temperature converts the rate of temperature change into the initial heater duty cycle. In one example piecewise-continuous function, graphically illustrated as curve 500, the initial heater duty cycle is negatively proportional to the rate of temperature change below a given rate R in a segment 510, and constant above the given rate R in a segment 520.

In one example, the function is determined empirically by heating the dryer from an initial dryer temperature to a given target temperature, recording the rate of temperature change at the point where the target temperature is met or exceeded, and recording the heater duty cycle that kept the dryer temperature at the target temperature. This yields an x-y data point (initial heater duty cycle for a particular rate of temperature change). By varying, for a given target temperature, the initial dryer temperature, the speed of the dryer fan, and the line voltage (as different countries and regions have different supply voltages) in different combinations over a number of heating cycles, a number of x-y data points usable to construct the function for a particular target temperature are obtained which cover the range of initial dryer temperatures, fan speeds, and line voltages.

Curve fitting is then used to empirically define the function. First, a lower limit for the initial heater duty cycle is identified. It is undesirable for the initial heater duty cycle to have too low a value or to be turned off (duty cycle=0%). In some examples, this is because although the dryer stores heat very well, it is not 100% efficient. During the time the dryer is commanded to maintain a target temperature above ambient, some heat losses will occur in the dryer and thus heat energy will have to be input to the dryer to keep it at the target temperature. As a result, x-y data points for higher rates of temperature change that would result in a heater duty cycle lower than the lower limit are discarded. This defines segment 520 and rate R. Curve fitting is then applied to the remaining x-y data points. While segment 510 corresponds to a linear function, in other examples the function is non-linear.

The resulting function thus specifies higher initial heater duty cycles for lower rates of temperature change where less heat is retained in the dryer, and lower initial heater duty cycles for higher rates of temperature change where more heat is retained in the dryer. In one example, the function is used to calculate the initial heater duty cycle from the rate of temperature change. In another example, the function is converted to a lookup table and the rate of temperature change is used to look up the corresponding initial heater duty cycle in the table.

Figure 6:
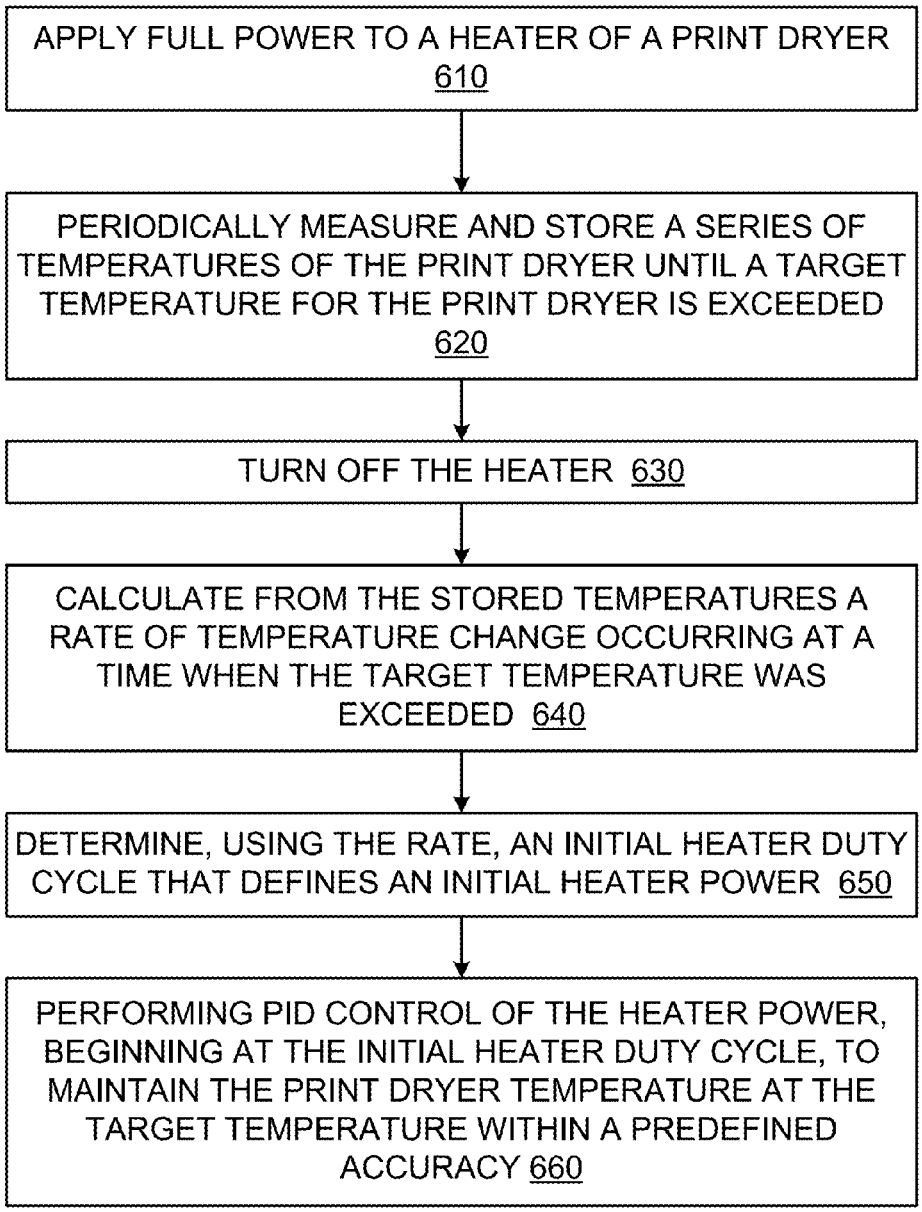
FIG. 6 is a flowchart in accordance with an example of the present disclosure of a method for controlling the temperature of a print dryer usable with the printer of FIGS. 1 and 2.

Considering now one example method for controlling the temperature of a print dryer, and with reference to FIG. 6, a method 600 may be used with the print dryer 100 (FIG. 1), 200 (FIG. 2). The method 600 begins at 610 by applying full power to a heater of the print dryer.

At 620, a series of temperatures of the print dryer are periodically measured and stored while full power is being applied. This continues until the temperature of the print dryer exceeds a target temperature to which it is desired to heat the print dryer. In some examples, it continues until the temperature of the print dryer exceeds the target temperature by a specified amount.

At 630, the heater is turned off.

At 640, a rate of temperature change at a time when the target temperature was exceeded is calculated from the stored temperatures. In some examples, the rate is calculated in the same or similar manner as has been described heretofore with reference to FIGS. 3A, 3B, and 4.

At 650, an initial heater duty cycle that defines an initial heater power is determined using the rate. The duty cycle serves the same purpose, and may be calculated in the same or similar manner, as has been described heretofore with reference to FIG. 5.

At 660, PID control of the heater power is performed, beginning at the initial heater duty cycle, in order to maintain the print dryer temperature close to the target temperature. In one example, the print dryer temperature is maintained at the target temperature within a predefined accuracy. In one example, the dryer temperature is maintained at the target temperature with an accuracy of +/−5 degrees C. or +/−16% of the target temperature. In another example, the temperature is maintained with an accuracy of +/−1 degrees C. or +/−3% of the target temperature. A PID controller subsequently varies the heater duty cycle, based on periodic temperature measurements of the print dryer, to maintain the dryer temperature at the target temperature within the predefined accuracy. When the measured temperature is below the target temperature, the heater duty cycle may be increased, and when the measured temperature is above the target temperature, the heater duty cycle may be decreased, in order to maintain the dryer temperature close to the target temperature.

Figure 7:
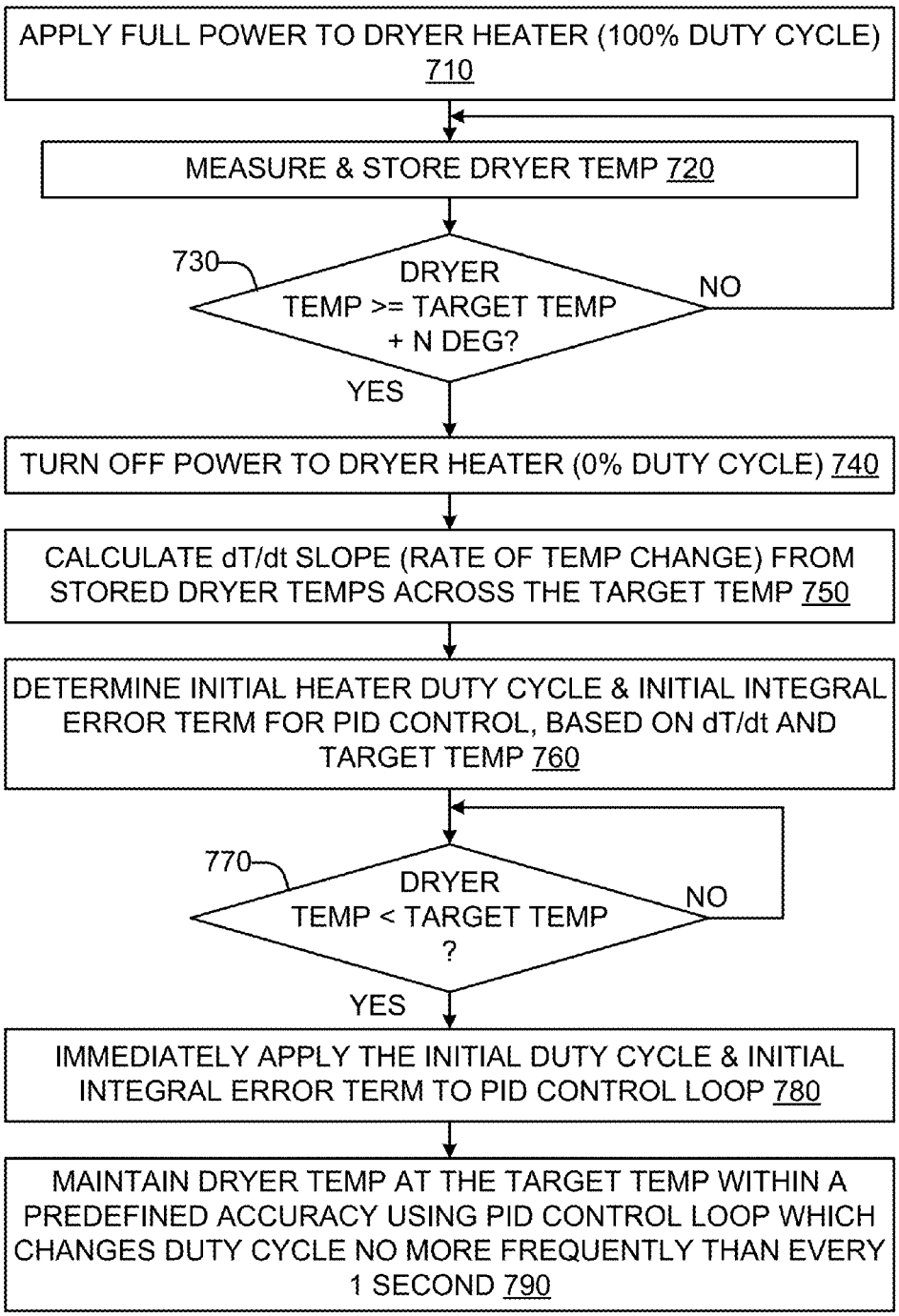
FIG. 7 is a flowchart in accordance with an example of the present disclosure of another method for controlling the temperature of a print dryer usable with the printer of FIGS. 1 and 2.

Considering now another example method for controlling the temperature of a print dryer, and with reference to FIG. 7, a method 700 may be used with the print dryer 100 (FIG. 1), 200 (FIG. 2). In some examples, the method 700 is initiated when a print job is received by the printer. The method 700 begins at 710 by applying full power to a heater of the print dryer. In some examples, this is accomplished by setting a 100% duty cycle for the operation of the heater.

At 720, a temperature of the print dryer is measured and stored while full power is being applied. At 730 it is determined whether the measured temperature of the print dryer is equal to or greater than N degrees above a target temperature for the print dryer. If not ("No" branch of 730), the method branches to 720. If so ("Yes" branch of 730), then at 740 power to the heater is turned off. In some examples, this is accomplished by setting a 0% duty cycle for the operation of the heater.

At 750, a dT/dt slope for the rate of temperature change at a time when the dryer temperature crosses from below the target temperature to above the target temperature is calculated from the stored temperatures. In some examples, the rate is calculated in the same or similar manner as has been described heretofore with reference to FIGS. 3A, 3B, and 4.

At 760, an initial heater duty cycle is determined, based on the dT/dt slope and the target temperature. An initial integral error term is then calculated using the initial heater duty cycle. The initial heater duty cycle serves the same purpose, and may be calculated in the same or similar manner, as has been described heretofore with reference to FIG. 5.

At 770, the print dryer temperature is measured and compared to the target temperature. After power to the dryer heater is turned off at 740, the dryer temperature begins to drop towards the target temperature. If the dryer temperature is greater than or equal to the target temperature ("No" branch of 770), the method loops to 770 to perform another measurement. If the dryer temperature is less than the target temperature ("Yes" branch of 770), the method continues at 780.

At 780, the initial heater duty cycle and the initial integral error term are immediately applied to the PID control loop, which in turn immediately applies the initial heater duty cycle to the heater of the print dryer. Even though the PID control loop normally restricts how frequently the duty cycle can be changed, the initial duty cycle is nonetheless applied to the heater of the print dryer immediately upon receipt by the PID control loop.

At 790, the PID control loop maintains the print dryer temperature at the target temperature within a predefined accuracy while changing the duty cycle no more frequently than a predetermined amount of time. In one example, the duty cycle is changed no more frequently than every 1 second. In another example, the duty cycle is changed no more frequently than every 6.1 seconds. The PID control loop measures the temperature of the print dryer, which may be the temperature of the air within the dryer. When the measured temperature is below the target temperature, the PID control loop may increase the heater duty cycle, and when the measured temperature is above the target temperature, the PID control loop may decrease the heater duty cycle, in order to maintain the temperature.

In some examples, after an operation by the print dryer to dry a wet printed medium in the dryer has been completed, the PID control loop is deactivated and power to the dryer is turned off. In other examples, operation of the PID control loop is continued for at least a period of time after a print drying operation has been completed.

Figure 8:
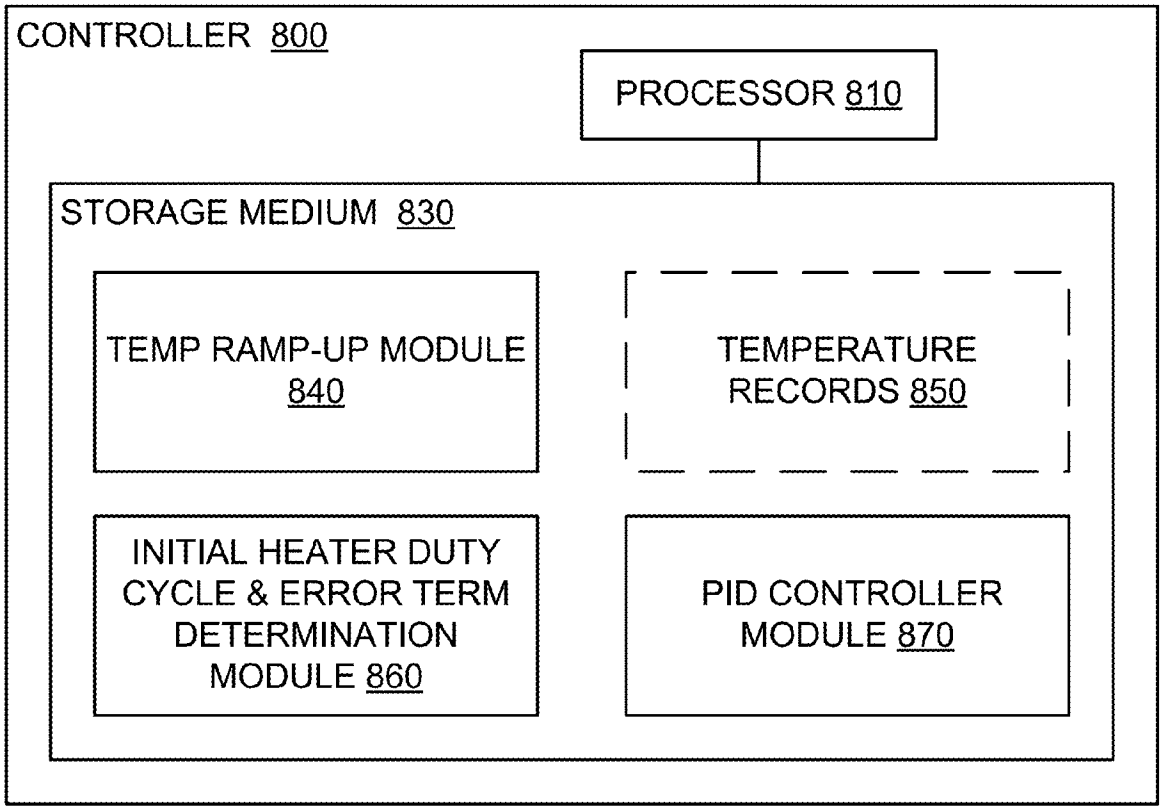
FIG. 8 is a schematic representation of a controller of a print dryer in accordance with an example of the present disclosure usable with the printer of FIGS. 1 and 2.

Considering now one example controller of a print dryer, and with reference to FIG. 8, a controller 800 may be the controller 170 (FIG. 1) and/or the controller 240 (FIG. 2). The controller 800 includes a processor 810 which is communicatively coupled to a non-transitory computer-readable storage medium 830 which has stored program instructions executable by the processor 810. In one example, the controller 800 implements the method 600 (FIG. 6) and/or the method 700 (FIG. 7).

The storage medium 830 includes a temperature ramp-up module 840, an initial heater duty cycle determination module 860, and a PID control loop controller module 870 to implement the corresponding functions of the controller. The storage medium 830 is also usable to store data in the form of temperature records 850 which may be generated by the temperature ramp-up module 840 and utilized by the initial heater duty cycle determination module 860.

In some examples, the temperature ramp-up module 840 includes instructions to apply a high duty cycle to a heater of a print dryer to turn the heater on at high power;

repetitively measure and record a temperature of the dryer while heating at the high power; and when the dryer exceeds a target temperature, apply a low duty cycle to the heater or turn off the heater.

In some examples, the initial heater duty cycle determination module 860 includes instructions to calculate from the recorded temperatures a rate of temperature change across the target temperature, and determine an initial heater duty cycle corresponding to the rate. In one such example, the duty cycle is determined from the rate according to a piecewise-continuous function associated with the target temperature, where the initial heater duty cycle is negatively proportional to the rate below a given rate and constant above the given rate. In some examples, the initial heater duty cycle determination module 860 further includes instructions to calculate, using the rate of temperature change and the initial heater duty cycle, an initial integral error term for PID control, and to preload the initial integral error term to the PID controller module 870.

In some examples, the PID controller module 870 includes instructions to perform PID control of the heater beginning with the initial heater duty cycle, and using the preloaded initial integral error term, to maintain the print dryer at the target temperature within a predefined accuracy. In one such example, after the initial heater duty cycle is applied to the heater, the duty cycle changes no more frequently than every one second.

In some examples, the computer readable storage medium 830 may be implemented as a semiconductor memory device such as DRAM, or SRAM, an Erasable and Programmable Read-Only Memory (EPROM), an Electrically Erasable and Programmable Read-Only Memory (EEPROM) and/or a flash memory; a magnetic disk such as a fixed, floppy and/or removable disk; other magnetic media including tape; and an optical medium such as a Compact Disk (CD) or Digital Versatile Disk (DVD). The instructions of the modules discussed above can be provided on one computer-readable or computer-usable storage medium, or alternatively, can be provided on multiple computer-readable or computer-usable storage media distributed in a large system having possibly plural nodes. Such computer-readable or computer-usable storage medium or media is (are) considered to be part of an article (or article of manufacture). An article or article of manufacture can refer to any manufactured single component or multiple components.

While the controller 800 has been illustrated as being implemented in firmware and/or software, in other examples the functions of a controller for the print dryer may be implemented at least in part in hardware instead of in firmware or software.

In some examples, at least one block or step discussed herein is automated. In other words, apparatus, systems, and methods occur automatically. As defined herein and in the appended claims, the terms "automated" or "automatically" (and like variations thereof) shall be broadly understood to mean controlled operation of an apparatus, system, and/or process using computers and/or mechanical/electrical devices without the necessity of human intervention, observation, effort and/or decision.

From the foregoing it will be appreciated that the printer, method, and storage medium provided by the present disclosure represent a significant advance in the art. Although several specific examples have been described and illustrated, the disclosure is not limited to the specific methods, forms, or arrangements of parts so described and illustrated. This description should be understood to include all combinations of elements described herein, and claims may be presented in this or a later application to any combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A method for controlling temperature of a print dryer, comprising:

applying full power to a heater of the print dryer;

repetitively measuring and storing a series of temperatures of the print dryer until a target temperature for the print dryer is exceeded;

turning off the heater after the target temperature is exceeded;

calculating from the stored temperatures a rate of temperature change at a time when the target temperature was exceeded;

determining, using the rate, an initial heater duty cycle defining an initial heater power, wherein the determining comprises converting the rate of temperature change into the initial heater duty cycle according to a piecewise-continuous function associated with the target temperature, where the initial heater duty cycle is negatively proportional to the rate below a given rate and constant above the given rate; and performing proportional-integral-derivative (PID) control of the heater power, beginning with the initial heater duty cycle, to maintain the print dryer temperature at the target temperature within a predefined accuracy.

2. The method of claim 1, comprising:

applying the initial heater duty cycle to a PID controller, the PID controller changing the heater duty cycle no more frequently than every one second.

3. The method of claim 1, comprising:

applying the initial heater duty cycle to the PID controller, the PID controller changing the heater duty cycle no more frequently than every six seconds.

4. The method of claim 1, wherein wet printed media is provided to the print dryer while applying the full power before the target temperature is exceeded.

5. The method of claim 1, wherein the rate of temperature change is negatively proportional to a difference between the target temperature and a lower temperature of the print dryer at a time the full power is applied.

6. The method of claim 1, comprising:

before applying the initial heater duty cycle, waiting for the temperature of the print dryer to fall below the target temperature.

7. The method of claim 1, wherein the determining includes calculating, using the rate and the initial heater duty cycle, an initial integral error term for the PID control, and wherein the performing includes preloading the initial integral error term for the PID control.

8. The method of claim 1, wherein the full power is at least 500 watts.

9. The method of claim 1, wherein the predefined accuracy for the target temperature is less than +/−3% of the target temperature.

10. A non-transitory computer-readable storage medium having an executable program stored thereon, wherein the program instructs a processor to:

apply a high duty cycle to turn on a heater of a print dryer at high power;

repetitively measure and record a temperature of the print dryer while heating at the high power;

apply a low duty cycle to turn off the heater when the print dryer exceeds a target temperature;

calculate from the recorded temperatures a rate of temperature change across the target temperature;

determine an initial heater duty cycle corresponding to the rate, wherein the determining comprises converting the rate of temperature chance into the initial heater duty cycle according to a piecewise-continuous function associated with the target temperature, where the initial heater duty cycle is negatively proportional to the rate below a given rate and constant above the given rate, and perform proportional-integral-derivative (PID) control of the heater beginning with the initial heater duty cycle to maintain the print dryer at the target temperature within a predefined accuracy.

11. The medium of claim 10, wherein to determine the initial heater duty cycle the program further instructs the processor to:

determine the duty cycle from the rate according to a piecewise-continuous function associated with the target temperature, where the initial heater duty cycle is negatively proportional to the rate below a given rate and constant above the given rate.

12. The medium of claim 10, wherein after the initial heater duty cycle is applied to the heater, the duty cycle is changed no more frequently than every one second.

13. The medium of claim 10, wherein the program further instructs the processor to calculate, using the rate and the initial heater duty cycle, an initial integral error term for the PID control, and to preload the initial integral error term.

* * * * *